US006778056B2

(12) United States Patent
Ito et al.

(10) Patent No.: US 6,778,056 B2
(45) Date of Patent: Aug. 17, 2004

(54) INDUCTANCE COMPONENT HAVING A PERMANENT MAGNET IN THE VICINITY OF A MAGNETIC GAP

(75) Inventors: Toru Ito, Miyagi (JP); Hatsuo Matsumoto, Sendai (JP); Teruhiko Fujiwara, Sendai (JP); Kazuyuki Okita, Sendai (JP); Toshiya Sato, Natori (JP)

(73) Assignee: NEC Tokin Corporation, Sendai (JP)

( * ) Notice: Subject to any disclaimer, the term of this patent is extended or adjusted under 35 U.S.C. 154(b) by 0 days.

(21) Appl. No.: 09/920,051

(22) Filed: Aug. 1, 2001

(65) Prior Publication Data

US 2002/0033747 A1 Mar. 21, 2002

(30) Foreign Application Priority Data

| | | |
|---|---|---|
| Aug. 4, 2000 | (JP) | 2000-237393 |
| Sep. 8, 2000 | (JP) | 2000-274183 |
| Nov. 29, 2000 | (JP) | 2000-362308 |

(51) Int. Cl.[7] ..... H01F 21/00
(52) U.S. Cl. ..... 336/110; 336/178; 336/212
(58) Field of Search ..... 336/110, 155, 336/165, 178, 212

(56) References Cited

U.S. PATENT DOCUMENTS 2,774,935 A * 12/1956 Rademakers et al. ..... 336/110
3,671,810 A * 6/1972 Barnes et al. ..... 336/155

FOREIGN PATENT DOCUMENTS

| | | |
|---|---|---|
| EP | 0744757 A1 | 11/1996 |
| JP | 1-169905 | 5/1989 |
| JP | 03-92013 | 9/1991 |
| JP | 08-316049 | 11/1996 |

OTHER PUBLICATIONS

Patent Abstracts of Japan, vol. 1999, No. 12, Oct. 29, 1999 and JP 11–176644 A (Saito Masaru), Jul. 2, 1999—Abstract only.

* cited by examiner

*Primary Examiner*—Tuyen T. Nguyen
(74) *Attorney, Agent, or Firm*—Frishauf, Holtz, Goodman & Chick, P.C.

(57) ABSTRACT

An inductance component comprises a magnetic core having at least one magnetic gap, means for generating a direct-current biased magnetic field produced by mounting a permanent magnet in the vicinity of a generally closed magnetic circuit which passes through the magnetic gap in the magnetic core or on the outside thereof, and a coil wound around the magnetic core, wherein the permanent magnet is mounted near the magnetic gap at one or more legs of the magnetic core which sandwich the magnetic gap.

3 Claims, 19 Drawing Sheets

INDUCTANCE COMPONENT HAVING A PERMANENT MAGNET IN THE VICINITY OF A MAGNETIC GAP

BACKGROUND OF THE INVENTION

1. Field of the Invention

The present invention relates to a magnetic device having a coil wound around a magnetic core, and more specifically to an inductance component like an inductor or a transformer, which is used in various electronics and power sources to reduce core loss using direct current bias.

2. Description of the Related Art

Recently, various electronics are becoming smaller and more lightweight. Accordingly, the relative volume ratio of a power source section to the entire electronics is tending to increase. This is because, while various circuits are subjected to large-scale integration (LSI), it is difficult to miniaturize magnetic components, such as an inductor and a transformer, which are essential for circuit elements of the power source section. Accordingly, various methods have been attempted in order to achieve miniaturization and weight reduction of the power source section.

It is effective to decrease the volume of a magnetic core composed of a magnetic material in order to obtain smaller and lightweight magnetic devices, such as an inductor and a transformer (hereinafter, referred to as an inductance component). Generally, miniaturizing the magnetic core easily causes magnetic saturation thereof. Thus, the amplitude of electric current being treated as power supply may be decreased.

In order to solve the above problems, a technique is well known to increase magnetic resistance of a magnetic core and to prevent decrease in the amplitude of the electric current therethrough by providing a part of the magnetic core with a magnetic gap. However, the magnetic inductance of the magnetic component is decreased in such a case.

As a method for preventing decrease in the magnetic inductance, a technique regarding a structure of a magnetic core using a permanent magnet for generating magnetic bias is disclosed in Japanese Unexamined Patent Application Publication No. 01-169905 (hereinafter, referred to as conventional art 1). In such a technique, a permanent magnet is used to apply direct current magnetic bias to the magnetic core, resulting in increasing the number of lines of magnetic force capable of passing through the magnetic gap.

However, since the magnetic flux produced by a coil wound around the magnetic core passes through the permanent magnet in the magnetic gap in the structure of the magnetic core of the conventional inductance component, the permanent magnet is demagnetized.

Also, the smaller the size of the permanent magnet inserted into the magnetic gap is, the larger the effects of the demagnetization due to external factors are.

SUMMARY OF THE INVENTION

Accordingly, it is an object of the present invention to provide an inductance component in which the permanent magnet being mounted has little limitation in shape, and in which the permanent magnet is not demagnetized by magnetic flux due to a coil wound around a magnetic core.

It is another object of the present invention to provide an inductance component in which generation of heat due to leakage flux of a coil wound around the magnetic core, and in which the properties of the permanent magnet and the inductor are not degraded.

According to an aspect of the present invention, there is provided a inductance component which comprises a magnetic core having at least one magnetic gap, means for generating a direct-current biased magnetic field produced by mounting at least one of permanent magnets in the vicinity of a generally closed magnetic circuit which passes through the magnetic gap in the magnetic core, and a coil wound around the magnetic core. In the inductance component, the at least one of permanent magnets are mounted in the vicinity of the magnetic gap at least one of end portions of the magnetic core. The end portions defining the magnetic gap therebetween.

According to another aspect of the present invention, there is provided an inductance component which comprises a magnetic core having at least one magnetic gap, means for generating a direct-current biased magnetic field produced by mounting at least one of permanent magnets in the vicinity of a generally closed magnetic circuit which passes through the magnetic gap in the magnetic core, and a coil wound around the magnetic core. In the inductance component, the at least one of the permanent magnets are arranged on at least one of the outside portions of the magnetic core except in the magnetic gap in the magnetic core.

DESCRIPTION OF THE PREFERRED EMBODIMENTS

An inductance component according to conventional art 1 will be described prior to describing the embodiments of the present invention for easily understanding the present invention.

Figure 1:
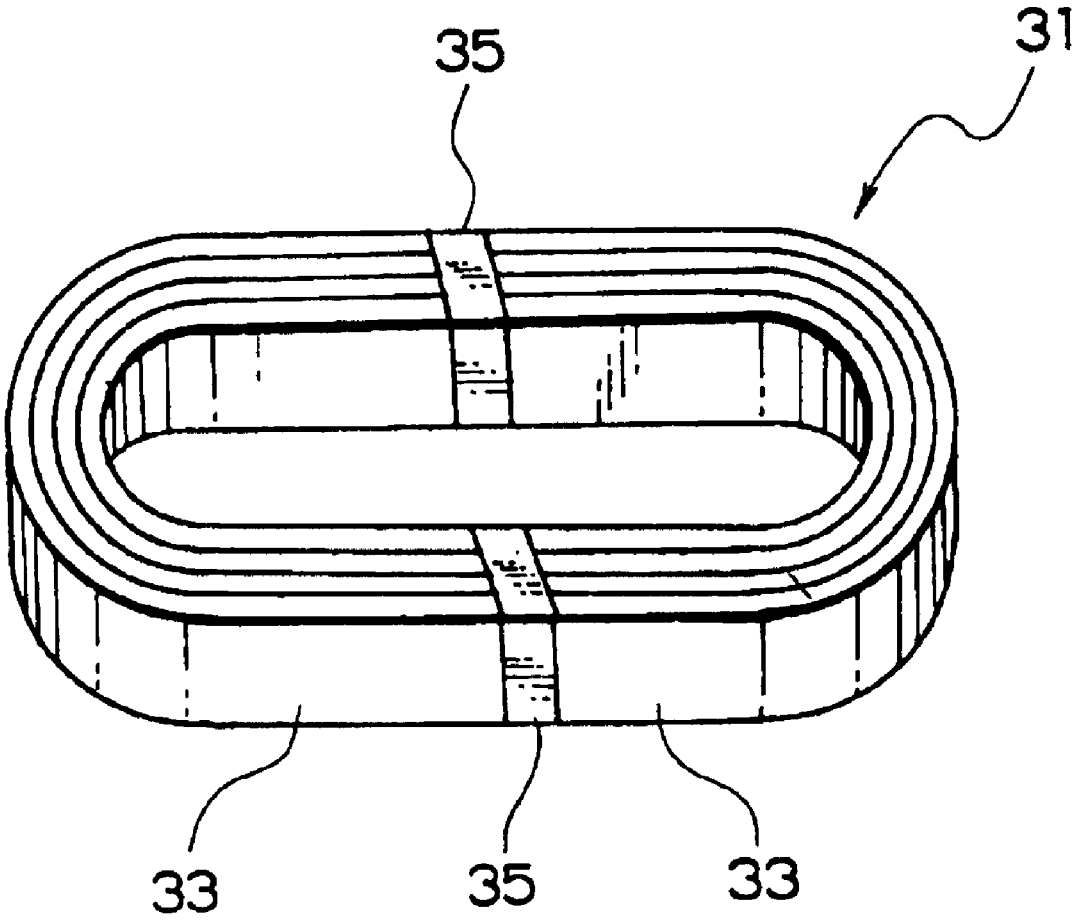
FIG. 1 PRIOR ART
FIG. 1 is a perspective view of a magnetic core used in a conventional inductance component.

Referring to FIG. 1, an inductance component 31 according to conventional art 1 has two magnetic cores 33, 33, two permanent magnets 35 and 35 each of which is inserted in corresponding one of two magnetic gaps provided between opposite end surfaces of magnetic cores 33.

Figure 2:
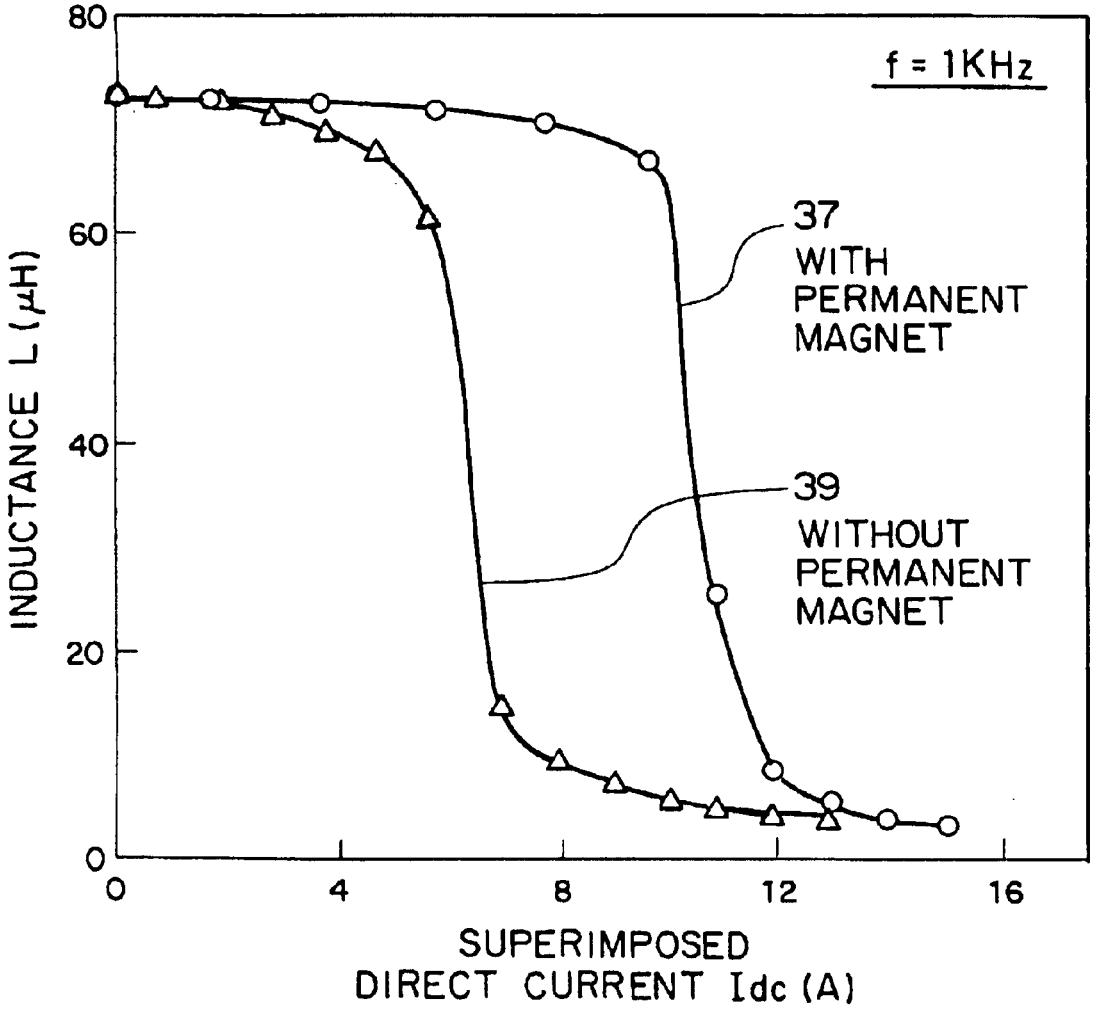
FIG. 2 PRIOR ART
FIG. 2 is a view showing the relationship between a superimposed direct current and inductance of each magnetic core when applying an alternating current of 1 kHz to each wound coil in the conventional inductance component having a permanent magnet and in the component having no permanent magnet in a magnetic gap of the magnetic core.

Referring to FIG. 2, when comparing the inductance-direct current superpositional characteristics when the permanent magnets 35 and 35 are inserted into the magnetic gaps in the magnetic cores 33, 33 with those of the case with no permanent magnets, the magnetic core 33 into which the permanent magnets 35 are inserted maintains a magnetic-inductance value higher than that of the magnetic core 33 having no permanent magnets 35 inserted thereinto even at a higher current.

Now, embodiments of the present invention will be described hereinbelow with reference to the drawings.

Figure 3:
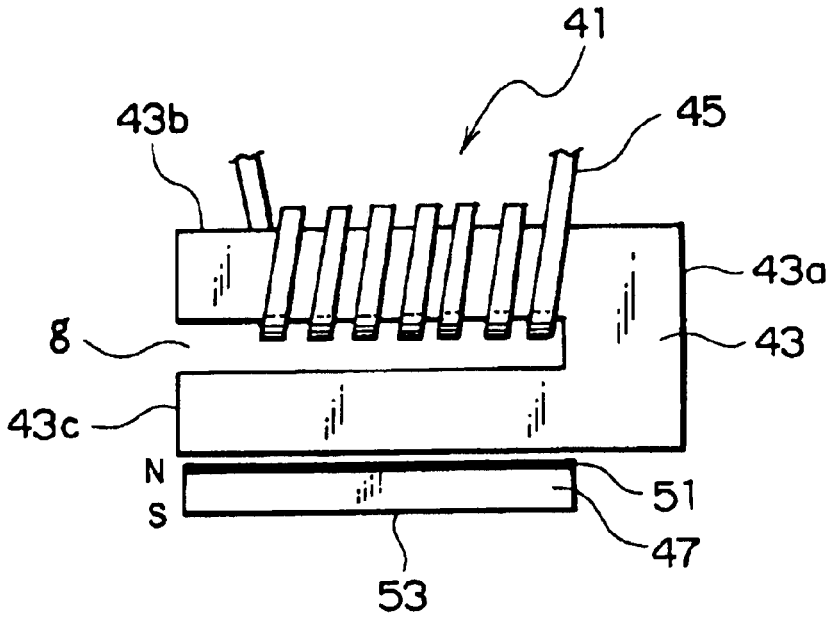
FIG. 3 is a view showing a structure of an inductance component according to a first embodiment of the present invention.

Referring to FIG. 3, an inductance component 41 according to a first embodiment of the present invention is composed of an inductor and includes a U-shaped magnetic core 43, a coil 45 wound around one magnetic leg 43*b*, and a permanent magnet 47 provided on the outside of the other magnetic leg 43*c*. The permanent magnet 47 is shaped like a plane and the entire surfaces are magnetized such that the thick line side is the N-pole 51 and the opposite side is the S-pole 53.

The magnetic core 43 is composed of one material, ferrite. Also, the permanent magnet 47 is formed of one material, SmCo. The coil 45 wound around the magnetic core 43 is made of a flat-type copper wire.

The inductance component 41 according to the first embodiment is configured such that the surface of the permanent magnet 47 facing the magnetic leg 43*c*, is the N-pole 51.

Figure 4:
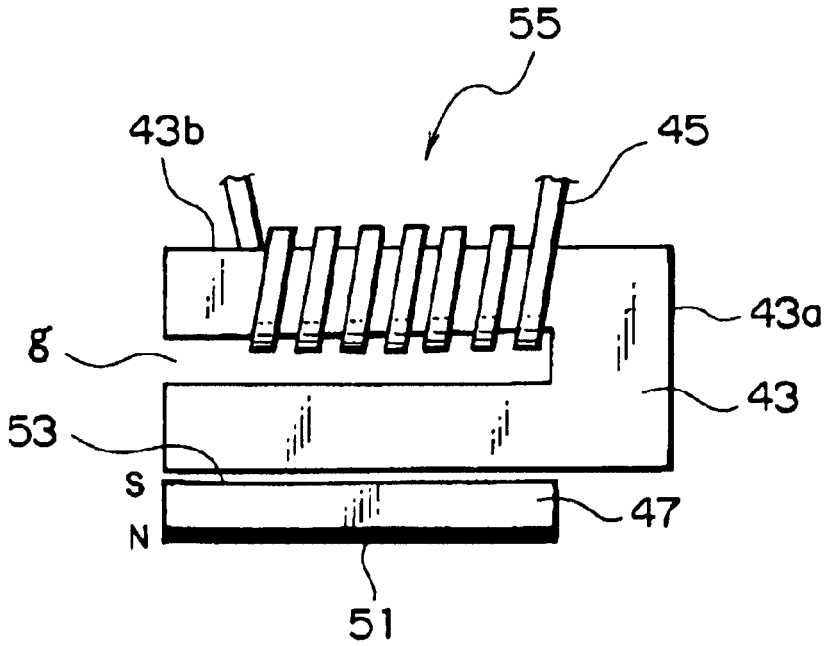
FIG. 4 is a view showing a structure of an inductance component according to a second embodiment of the present invention.

Referring to FIG. 4, an inductance component 55 according to a second embodiment of the present invention has the same structure as that of the first embodiment except that the magnetic-leg-side surface of the permanent magnet 47 is the S-pole 53.

Figure 5:
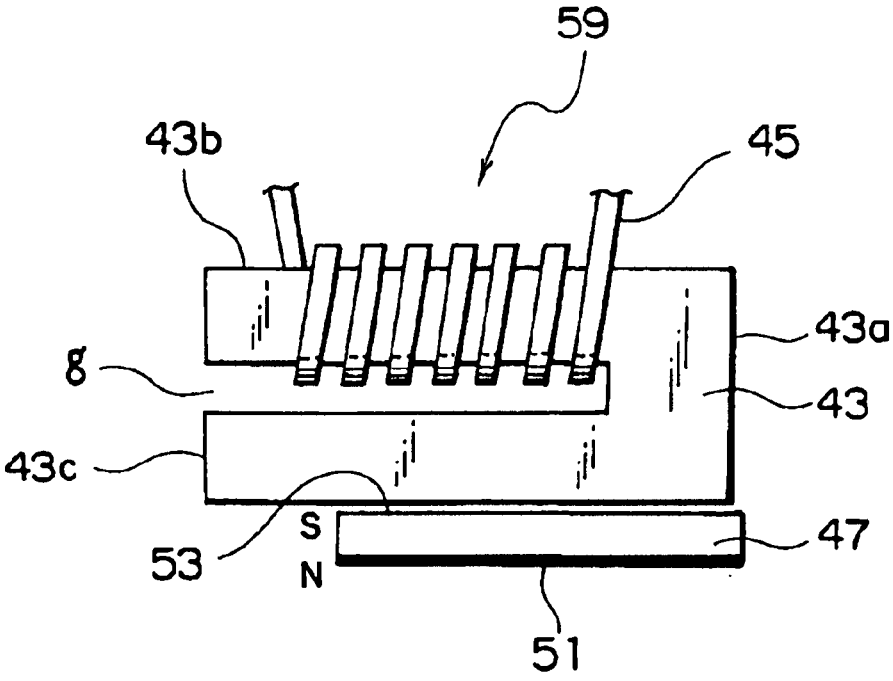
FIG. 5 is a view showing a structure of an inductance component according to a third embodiment of the present invention.

Referring to FIG. 5, an inductance component 59 according to a third embodiment of the present invention has the same structure as that of the third embodiment shown in FIG. 4 except that the permanent magnet 47 is positioned on the base portion 43*a* side of the magnetic leg 43*c*.

Figure 6:
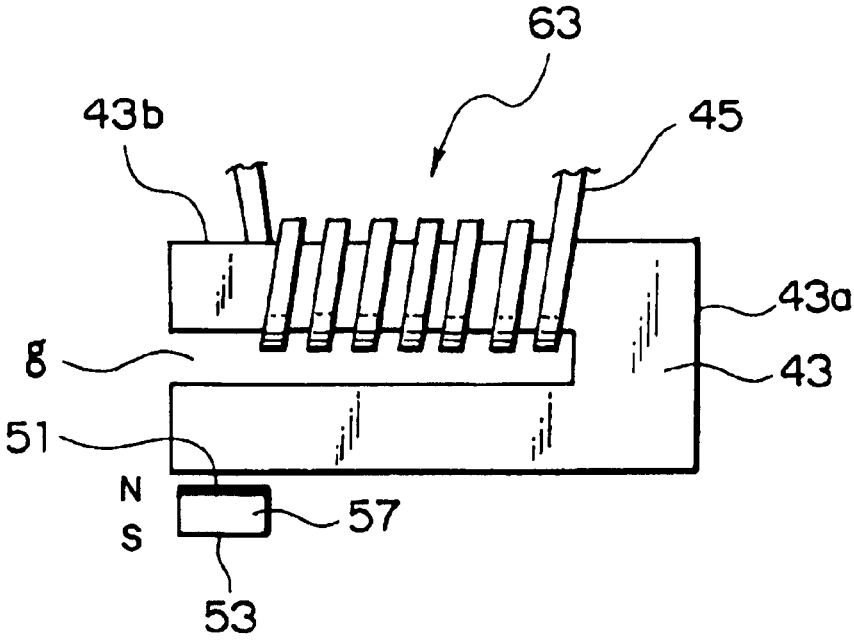
FIG. 6 is a view showing a structure of an inductance component according to a fourth embodiment of the present invention.

Referring to FIG. 6, in an inductance component 63 according to a fourth embodiment of the present invention, the planar permanent magnet 47 shown in FIGS. 3, 4, and 5 is cut into pieces of permanent magnet and only a piece 57 of magnet is disposed at a position where the most significant effects are obtained. The magnetic strength is defined by total number of lines of magnetic force generated from the permanent magnet, and is smaller than that of the above-described planar permanent magnet 47.

Figure 7:
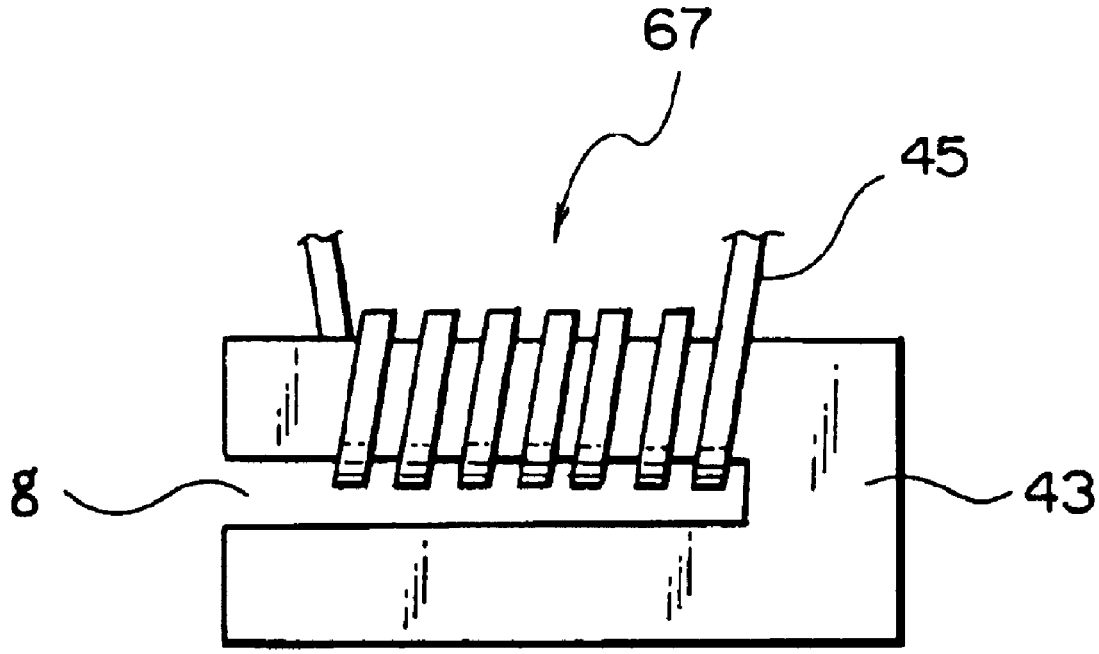
FIG. 7 is a view showing a structure of an inductance component manufactured for comparing with the inductance components according to the first to fourth embodiments.

Referring to FIG. 7, an inductance component 67 according to a comparative example has not a permanent magnet and is manufactured for comparison with the characteristics of the first to fourth embodiments of the present invention having the permanent magnet.

The material of the permanent magnets 47 and 57 used in the inductance components 41, 55, 59, and 63 is not limited to SmCo and may be any material so long as a sufficient magnetic strength can be obtained. Also, the material of the coil 45 wound around the magnetic core 43 is not limited to the flat-type copper wire and may be any coil of a material and a shape which can be preferably used as a component of the inductor.

The coil 45 wound around each magnetic core 43 of the inductance components shown in the first to fourth embodiments is subjected to an alternating current of 100 kHz and the relationship between the density of magnetic flux excited in the magnetic path in the magnetic core 43 and the core loss at that time is determined. The results are shown in FIG. 8.

Figure 8:
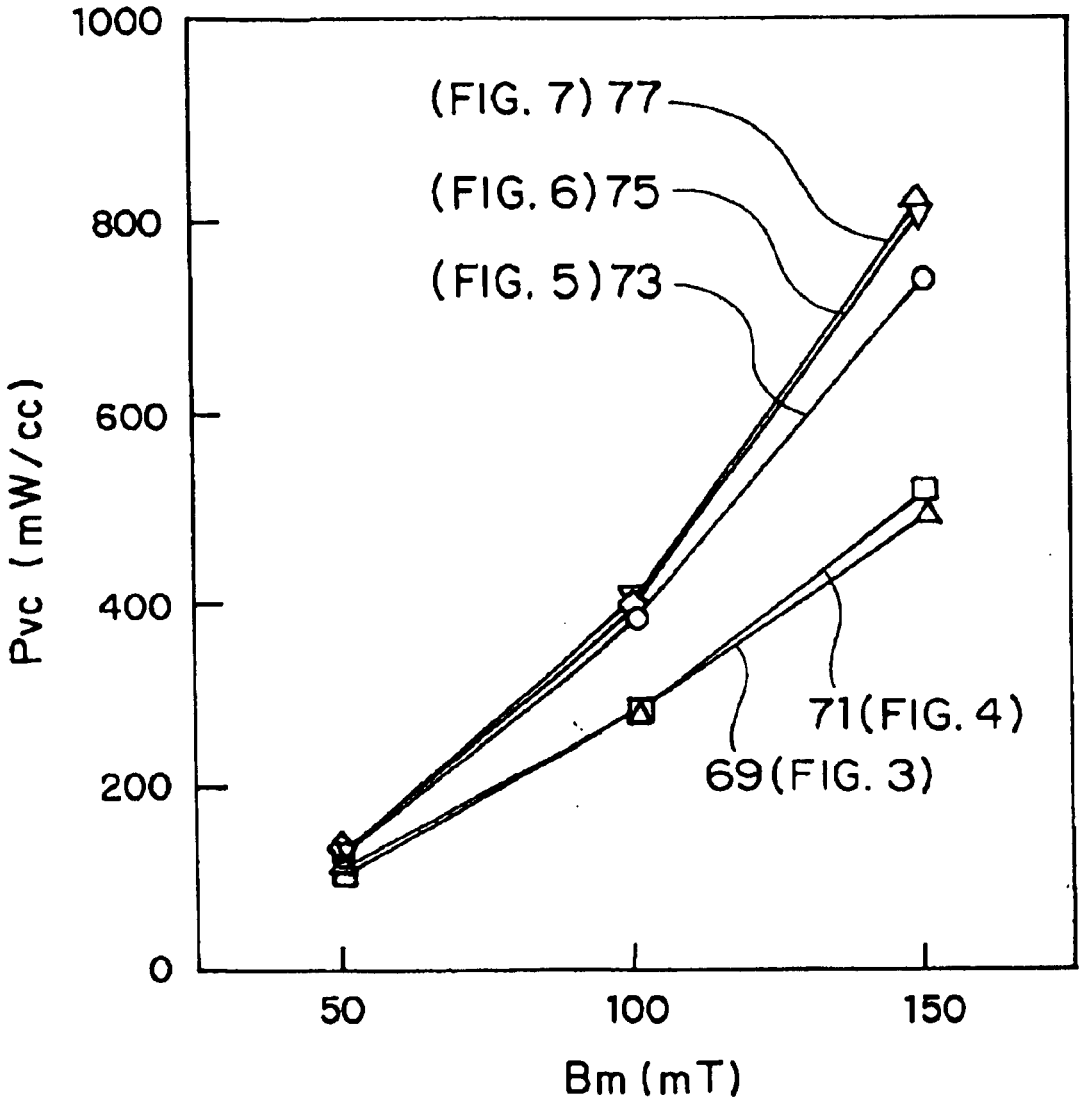
FIG. 8 is a view showing the relationship between the density of magnetic flux excited in a magnetic path in a magnetic core of the inductors according to the first to fourth embodiments of the present invention and the comparative example and a core loss at that time, that is, the relationship between the density (Bm) of magnetic flux passing through each magnetic core and a core loss (Pvc) when an alternating current of 100 kHz is applied to each wound coil.

Referring to FIG. 8, the results shown in graphs 69, 71, 73, 75, and 77 indicate that core losses are increased in order of the inductance components 41, 55, 59, 63, and 67 respectively shown in the first, second, third, fourth embodiments and the comparative example shown in FIG. 7, and that the position and the shape of the permanent magnets 47 and 57 have an influence on the amount of core losses.

By comparing the characteristic curve 69 of the inductance component 41 according to the first embodiment shown in FIG. 3 with the characteristic curve 73 of the inductance component 59 according to the third embodiment shown in FIG. 5, it is found that when the permanent magnet 47 is arranged so as to be slightly displaced from the area facing each other while sandwiching the magnetic gap in the magnetic core 43, as in the third embodiment shown in FIG. 5, core loss is smaller than that in the case where the permanent magnet 47 is arranged so as to cover the entire area facing each other, as shown in FIG. 3, and that arranging the permanent magnet 47 has a certain effect on decreasing core loss.

A comparison of the characteristic curve 69 of the inductance component 41 according to the first embodiment shown in FIG. 3 with the characteristic curve 75 of the inductance component 63 according to the fourth embodiment shown in FIG. 6 indicates that when a small permanent magnet 57 is disposed only in a part of the magnetic gap, as in the fourth embodiment shown in FIG. 6, the effect of mounting the permanent magnet is significantly decreased. That seems to indicate that the effect of mounting the permanent magnet is mainly pertinent to the proportion of the area covered by the permanent magnet to the area facing each other while sandwiching the magnetic gap in the magnetic core, and that the difference in effect depending on the position within the area is not large.

A comparison of the characteristic curve 69 of the inductance component 41 according to the first embodiment shown in FIG. 3 with the characteristic curve 71 of the inductance component 55 according to the second embodiment shown in FIG. 4 indicates that since core losses thereof are substantially the same, as shown in FIG. 8, the orientation of magnetization of the magnet has little bearing on the reduction in core loss.

When comparing the characteristic curve 77 of the inductance component 67 according to the comparative example shown in FIG. 7 with the characteristic curves 69, 71, 73, and 75 of the inductance components 41, 55, 59, and 63, it is found that arranging the permanent magnet 47 or 57 in the vicinity of the magnetic core 43 in any configuration is effective in decreasing core loss with varying degrees of effect.

In the inductance component 41 according to the first embodiment shown in FIG. 3 and the inductance component 67 according to the comparative example shown in FIG. 7, the coil 45 wound around the magnetic core 43 is subjected to a direct current of various amplitudes, and the superimposed direct current inductance is measured. The results of measurement are shown in FIG. 9.

Figure 9:
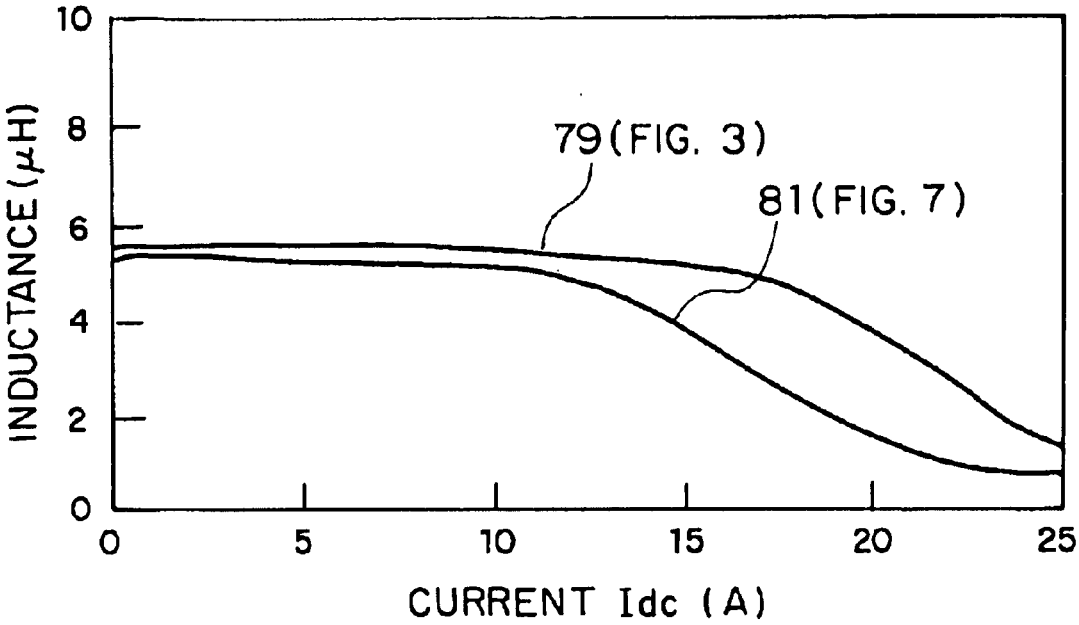
FIG. 9 is a view showing the relationship between a superimposed direct current of each magnetic core and inductance when an alternating current of 100 kHz is applied to coils wound around magnetic cores of the inductance component of the first embodiment of the present invention and the inductance component for comparison shown in FIG. 7.

Referring to FIG. 9, in the case of the inductance component 41 having the planar permanent magnet 47 according to the first embodiment shown in FIG. 3, the amplitude of the direct current at which the superimposed direct current inductance begins to decrease due to magnetic saturation of the magnetic core 43 is larger than that of the inductance component 67 according to the comparative example shown in FIG. 7.

Accordingly, in the case of the magnetic core 43 having the same component and shape, the planar permanent magnet 47 is arranged outside the magnetic core 43, that is, at a position through which the magnetic flux due to the coil 45 wound around the magnetic core 43 does not pass, so that a larger direct current can be treated.

In the first to fourth embodiments of the present invention, only the case of U-shaped magnetic core is shown as an example of the magnetic core 43. However, the same results can be obtained in an E-shaped magnetic core.

In the E-shaped magnetic core, generally, a coil is wound around a central portion thereof and two magnetic gaps exist. Accordingly, the planar permanent magnets are arranged on both outsides of the two magnetic gaps provided in the magnetic core, that is, at two positions opposite each gap while sandwiching the magnetic core main body, serving as means for generating magnetic bias.

An inductor as an inductance component having the E-shaped magnetic core will be described hereinbelow with reference to the drawings.

Figure 10:
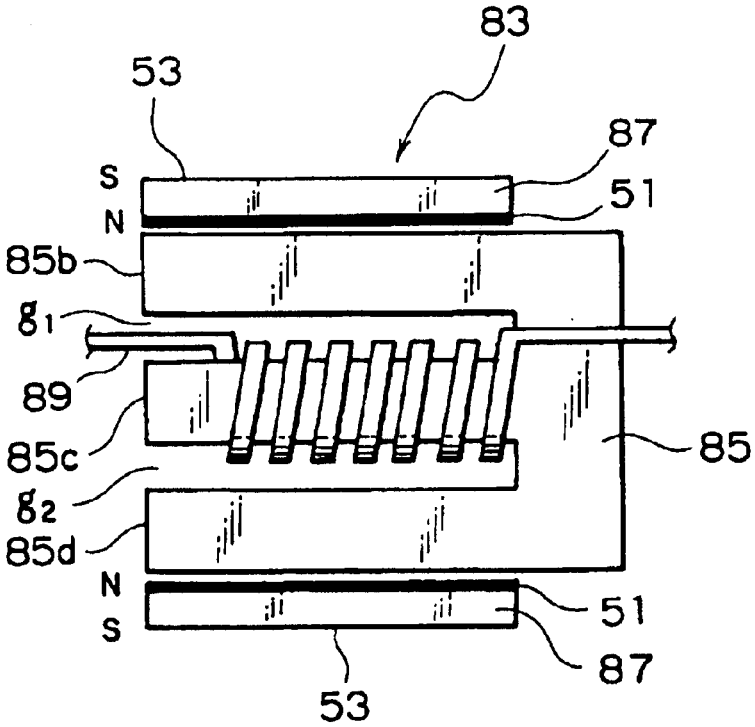
FIG. 10 is a view showing a structure of an inductance component according to a fifth embodiment of the present invention.

Referring to FIG. 10, an inductance component 83 according to a fifth embodiment of the present invention includes an E-shaped magnetic core 85, a coil 89 wound around a central magnetic leg 85*c*, and a pair of permanent magnets 87 each provided on the outside of the magnetic legs 85*b* and 85*d* on both sides of the central magnetic leg 85*c*.

Each permanent magnet 87 has a planar shape and is magnetized such that each of both entire surfaces has magnetic polarity. Each of the N-pole 51, which is indicated by the thick line, is arranged so as to be brought into contact with the surface of each of the magnetic legs 85*b* and 85*d*.

The magnetic core 85 is composed of one material, that is, ferrite. Also, the entire permanent magnet 47 is formed of a SmCo magnet. The coil 89 wound around the magnetic core 85 is made of a flat-type copper wire as in the case of the U-shaped magnetic core.

Figure 11:
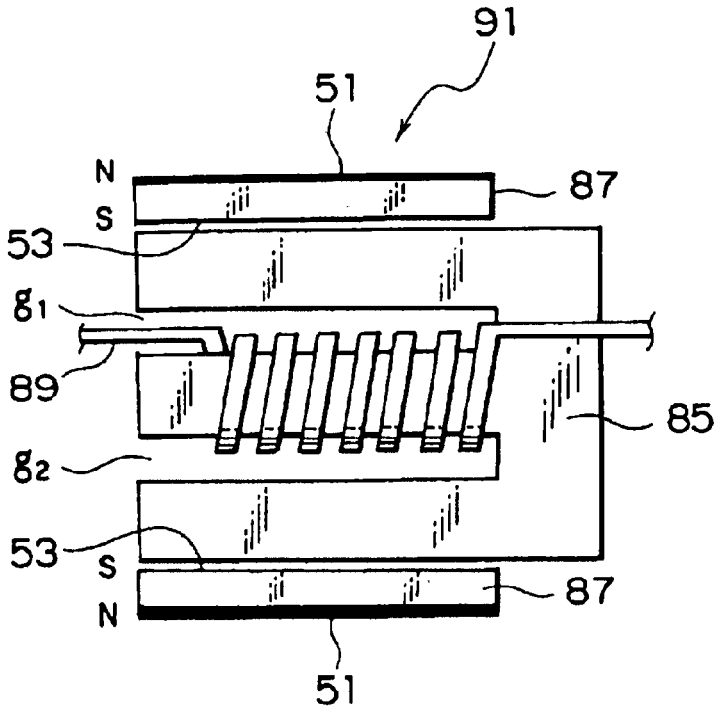
FIG. 11 is a view showing a structure of an inductance component according to a sixth embodiment of the present invention.

Referring to FIG. 11, an inductance component 91 according to a sixth embodiment of the present invention has the same structure as that of the inductance component 83 according to the fifth embodiment except that the orientation of the magnetic polarity of the permanent magnets 87 is different from each other. That is, the permanent magnet are provided to oppose the S-pole surfaces 53, 53 to each other.

Figure 12:
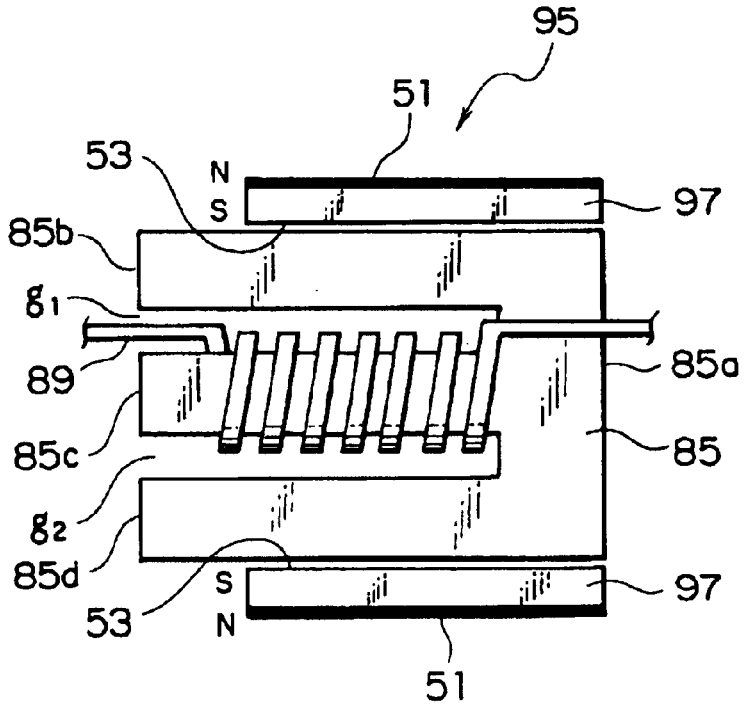
FIG. 12 is a view showing a structure of an inductance component according to a seventh embodiment of the present invention.

Referring to FIG. 12, the inductance component 95 according to a seventh embodiment of the present invention is different from the inductance component 83 according to the fifth embodiment and the inductance component 91 according to the sixth embodiment in that the permanent magnets 97, 97 are each arranged at a base portion 85*a* side.

Figure 13:
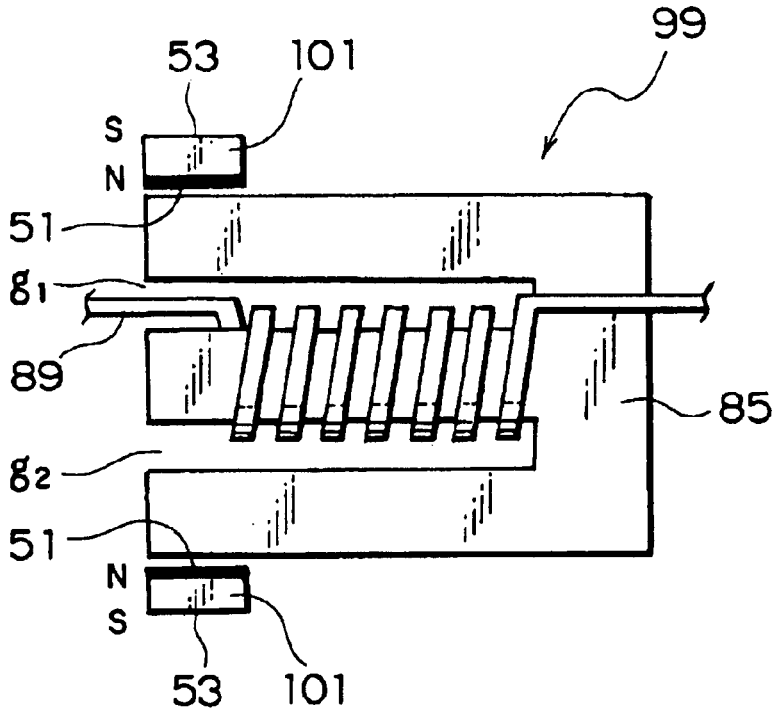
FIG. 13 is a view showing a structure of an inductance component according to an eighth embodiment of the present invention.

Referring to FIG. 13, in an inductance component 99 according to an eighth embodiment of the present invention, a planar permanent magnet is cut into pieces of permanent magnet and only a piece 101 of magnet is disposed at a position where the most significant effects are obtained. The magnetic strength is defined by total number of lines of magnetic force generated from the permanent magnet and is significantly smaller than that of the above-described planar permanent magnets.

Figure 14:
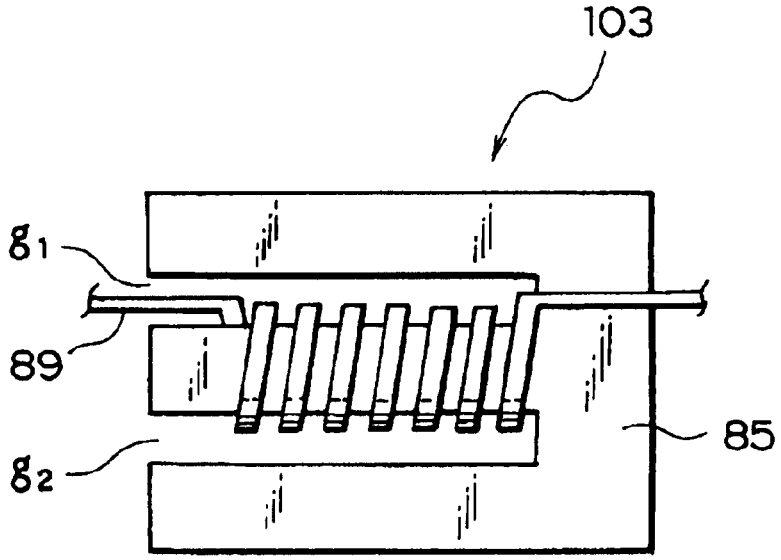
FIG. 14 is a view showing a structure of an inductance component manufactured for comparing with the inductance components according to the fifth to eighth embodiments of the present invention.

Referring to FIG. 14, an inductance component 103 according to a comparative example has a similar structure and shape to the fifth to ninth embodiments, however, has no permanent magnet.

In the inductance components 83, 91, 95, and 101 according to the fifth to ninth embodiments shown in FIGS. 10 to 13 and the inductance component 103 according to the comparative example shown in FIG. 14, the coil 89 wound around the magnetic core 85 is subjected to an alternating current, and the relationship between the density of magnetic flux excited in the magnetic path within the magnetic core 85 and the core loss at that time is measured. As a result, it is found that the effects of mounting the permanent magnet is decreased in order of the fifth embodiment shown in FIG. 10, the sixth embodiment shown in FIG. 11, the seventh embodiment shown in FIG. 12, the eighth embodiment shown in FIG. 13, and the comparative example having no permanent magnet shown in FIG. 14.

Among the above, no significant differences between the fifth embodiment shown in FIG. 10 and the sixth embodiment shown in FIG. 11 exists in which only the polarity of the permanent magnets is different.

The superimposed direct current inductance is measured for the inductance component 83 according to the fifth embodiment shown in FIG. 5 and the inductance component 103 according to the comparative example shown in FIG. 14, as in the case of the U-shaped magnetic core. It is found that the amplitude of the direct current at which the superimposed direct current inductance begins to decrease is increased by mounting the permanent magnet.

Accordingly, in the case of a magnetic core having the same component and shape, a planar permanent magnet is arranged outside the magnetic core, that is, at a position through which the magnetic flux due to the coil wound around the magnetic core does not pass, so that a larger direct current can be treated, as in the case of the U-shaped magnetic core.

Also, on the condition that the size and material of the permanent magnet and the coil used in the above embodiments and the material of the magnetic core are the same and also the volume of the magnetic cores is equal, the following facts are found.

In the U-shaped inductors according to the first to fourth embodiments shown in FIGS. 3 to 6 and the E-shaped inductors according to the fifth to eighth embodiments shown in FIGS. 10 to 13, when the condition of mounting the permanent magnet, they are roughly equal in core loss (Pvc) relative to the density (Bm) of magnetic flux passing through the magnetic core, and in the inductance of the magnetic core relative to the superimposed direct current irrespective of the shape of the magnetic cores.

As described above, according to the present invention, a planar or generally planar permanent magnet is arranged on the outside of the magnetic gap provided in the magnetic core, in other words, on the opposite side of the magnetic gap while sandwiching the magnetic core main body, thereby serving as means for generating magnetic bias. In this case, since the permanent magnet is arranged on the outside of the magnetic gap, there is no limitation on the size and shape of the permanent magnet corresponding to the shape of the magnetic gap. Also, since the permanent magnet does not exist on the path of the magnetic flux due to the wound coil, the permanent magnet is not subjected to demagnetization by the demagnetizing field due to the magnetic flux.

Such effects can be obtained in any of the U-shaped magnetic core and E-shaped magnetic core. By the above method, an inductor can be provided, in which core loss is decreased even when magnetic flux larger than previous one is passed through, and which can treat a larger electric current even if the size, shape, and material are the same. In other words, a smaller inductor and transformer can be manufactured without decreasing the amplitude of the electric current to be treated.

As described above, in the inductance components 41, 55, 59, 63, 83, 91, 95, and 101 according to the first to eighth embodiments of the present invention, an inductor having a small volume of magnetic core can be provided, in which there is little limitation on the shape of the permanent magnet mounted thereon and the permanent magnet is not demagnetized by the magnetic flux due to the coil wound around the magnetic core.

Figure 15:
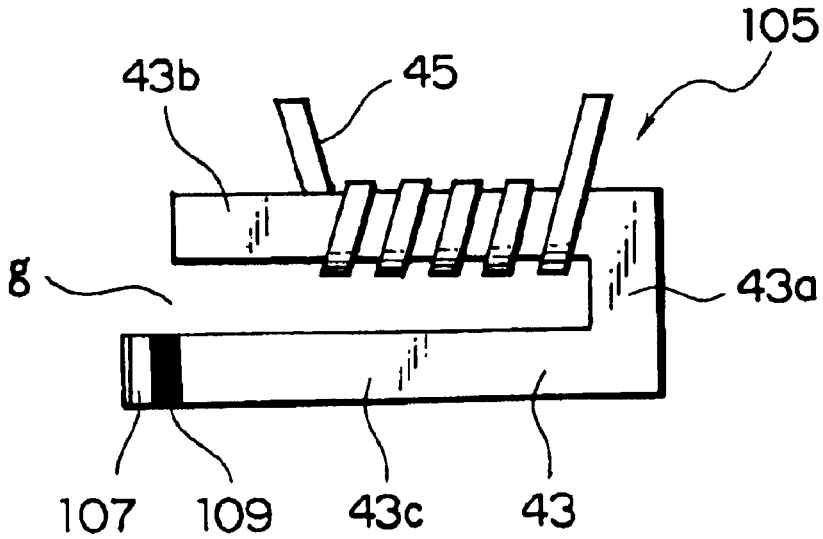
FIG. 15 is an explanatory view showing the configuration of an inductance component according to a ninth embodiment of the present invention when the N-pole of a permanent magnet is disposed on the extension of a magnetic path of a U-shaped inductor (magnetic) core.

Referring to FIG. 15, an inductance component 105 according to a ninth embodiment of the present invention includes the U-shaped inductor (or magnetic) core 43, the coil 45 wound around one magnetic leg 43*b* of the magnetic core 43, and a planar permanent magnet 107 mounted at the end surface of the other magnetic leg 43*c*. The thick line of the permanent magnet 107 indicates the N-pole 109. The magnetic core 43 is composed of one material, ferrite. The permanent magnet 107 is composed of one material, SmCo. The coil 45 wound around the magnetic core 43 is formed of a flat-type copper wire. The material of the permanent magnet 107 used for the inductance component 105 is not limited to SmCo, and may be any material having a sufficient strength.

Also, the material of the coil 45 wound around the magnetic core 43 is not limited to the flat-type copper wire, and may be any coil of a material and shape which can be preferably used as a component of the inductor.

Figure 16:
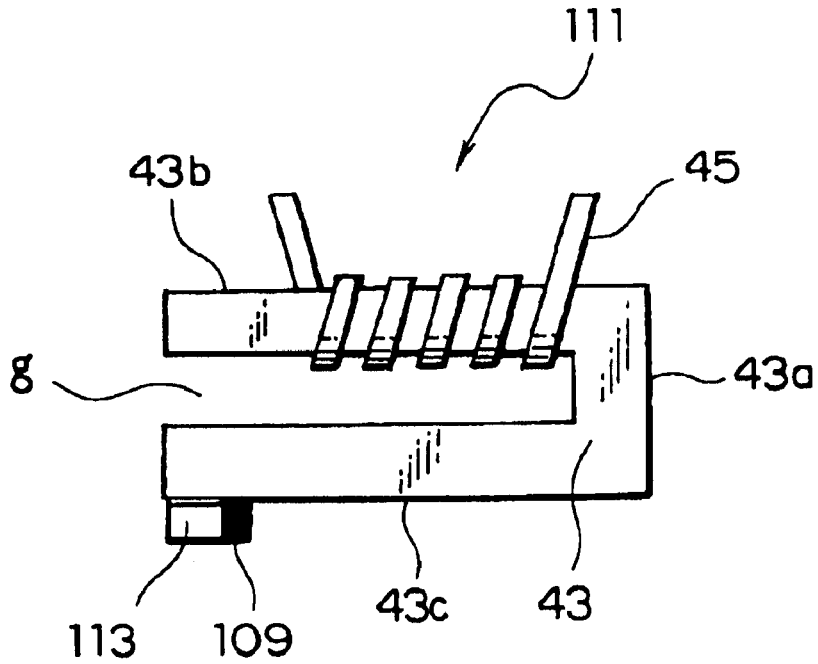
FIG. 16 is an explanatory view showing the configuration of an inductance component according to a tenth embodiment of the present invention when the N-pole of a permanent magnet is disposed in parallel with a magnetic path of a U-shaped inductor core.

Referring to FIG. 16, an inductance component 111 according to a tenth embodiment of the present invention has the same structure as those of the other embodiments except that a permanent magnet 113 is arranged on the outside in the vicinity of the end of the magnetic leg 43*c*.

Figure 17:
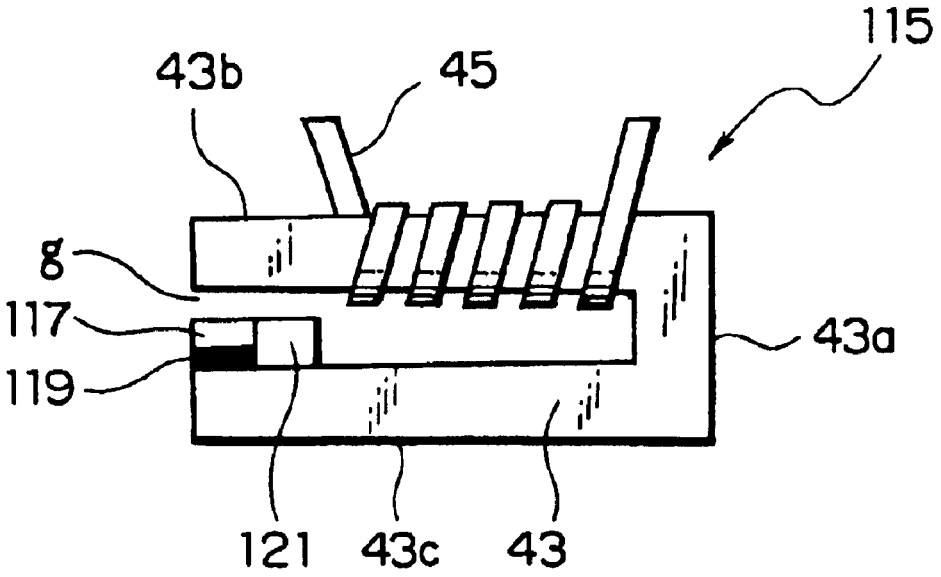
FIG. 17 is an explanatory view showing the configuration of an inductance component according to an eleventh embodiment of the present invention when a permanent magnet and a small piece of core are both disposed in a gap of a U-shaped inductor core.

Referring to FIG. 17, in an inductance component 115 according to an eleventh embodiment of the present invention, a permanent magnet 117 is arranged in an inner gap or magnetic gap in the vicinity of the end of the magnetic leg 43*c*, and a small piece of core 121 is arranged adjacent thereto near the base portion 43*a*. The magnetic core 43 composed of a soft magnetic material and the small piece of core 121 disposed in the magnetic gap need not be composed of the same material.

Figure 18:
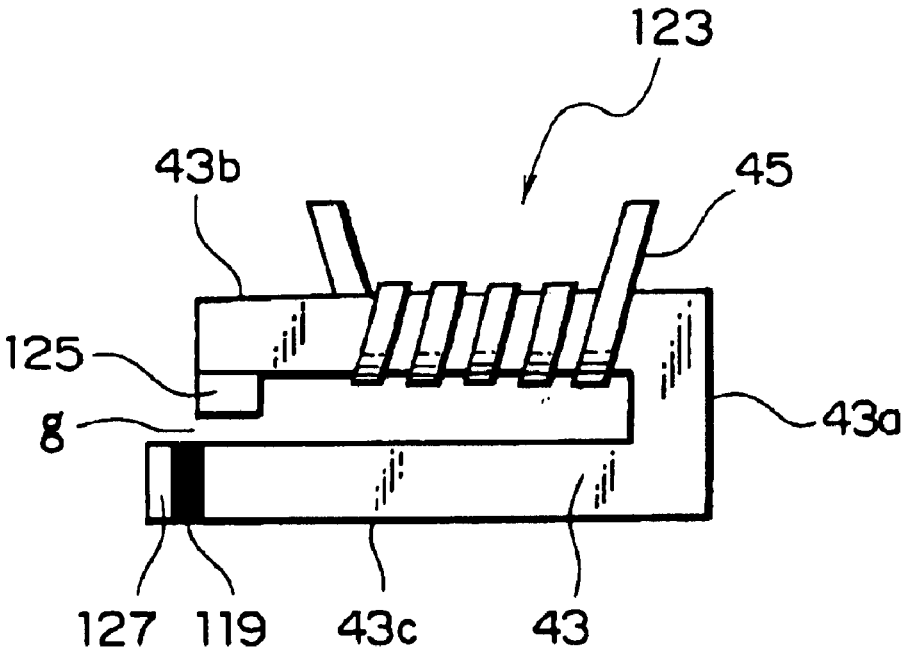
FIG. 18 is an explanatory view showing the configuration of a twelfth embodiment of the present invention in which a small piece of core is disposed in a gap at an end of a U-shaped inductor core and a permanent magnet is disposed at the other end of the core.

Referring to FIG. 18, an inductance component 123 according to a twelfth embodiment of the present invention is different from those of the other embodiments in that a permanent magnet 127 is arranged at the end surface of the magnetic leg 43*c*, and a small piece of core 125 is arranged inside of the end of the other magnetic leg 43*b*.

Figure 19:
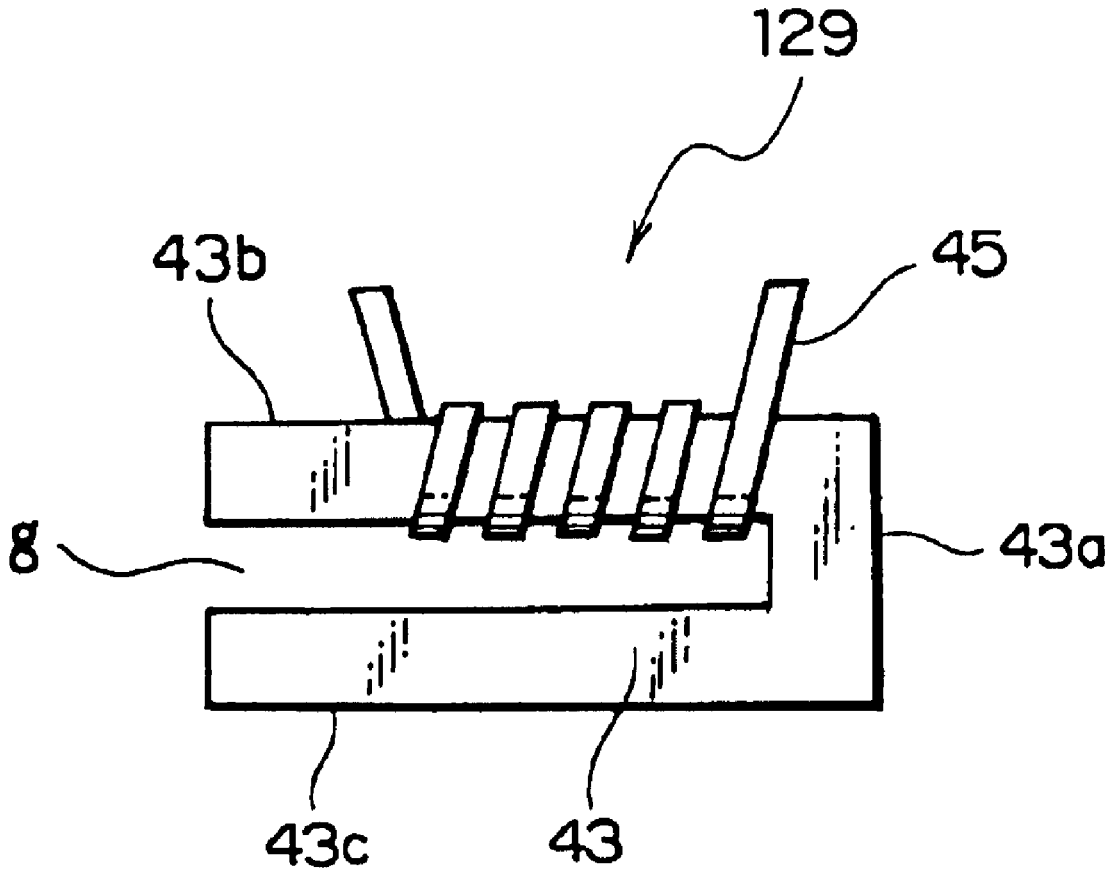
FIG. 19 is an explanatory view showing a comparative example in which no permanent magnet is disposed in the vicinity of a U-shaped inductor core.

Referring to FIG. 19, an inductance component 129 according to a comparative example has the U-shaped inductor or magnetic core 43 and the coil 45 wound around the magnetic leg 43*b* of the magnetic core 43, and includes no planar permanent magnet 107.

In the three types of inductance components, 105, 123, and 129, according to the ninth embodiment shown in FIG. 15, the twelfth embodiment shown in FIG. 18, and the comparative example shown in FIG. 19, respectively, a direct current is applied to each coil 45 wound around the magnetic core 43, and superimposed direct current inductance is measured. The results of measurement are shown in FIG. 20.

Figure 20:
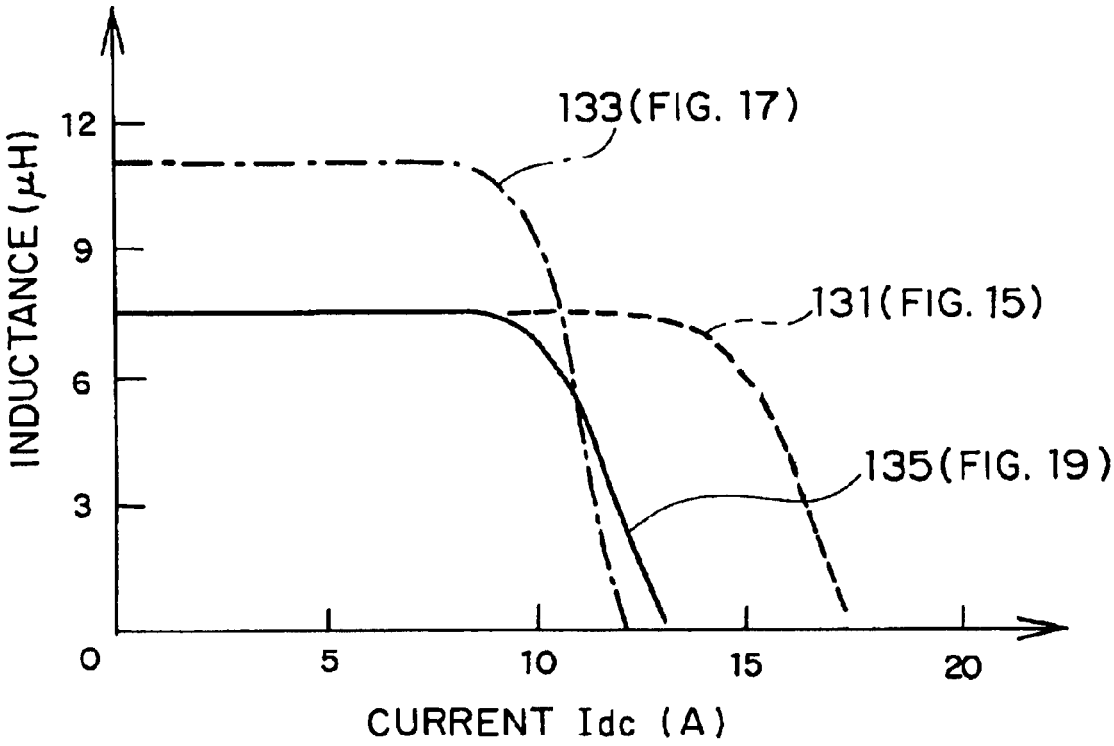
FIG. 20 is a graph illustrating the relationship between a superimposed direct current and inductance of the inductor cores according to the present invention shown in FIGS. 15 and 18 and those of the core according to the comparative example shown in FIG. 19 when an alternating current of 1 kHz is applied to each wound coil.

Referring to FIG. 20, as shown by a curve 131, in the ninth embodiment shown in FIG. 15, the amplitude of the direct current at which the superimposed direct current inductance begins to decrease due to magnetic saturation of the magnetic core 43 is larger than that of the comparative example, indicated by a curve 135, as shown in FIG. 19. Thus, in the case of a magnetic core of the same composition and shape, a magnetic core capable of treating a larger direct current can be designed by mounting a permanent magnet.

In the twelfth embodiment shown in FIG. 18, although the amplitude of direct current at which superimposed direct current inductance begins to decrease is the same as that of the comparative example shown in FIG. 19, the inductance is larger than that of the comparative example. Accordingly, in the case of a magnetic core of the same composition and shape, a magnetic core capable of treating larger inductance can be designed by mounting a permanent magnet.

With the inductance component 115 shown in FIG. 17, while the permanent magnet 117 is positioned in the gap in the U-shaped magnetic core 43, it is arranged adjacent to the small piece of core 121 disposed in the gap. Accordingly, most of the magnetic flux due to the coil 45 passes through the small piece of core 121 in the gap, so that the magnetic flux passing through the permanent magnet 47 is extremely little. Thus, large inductance can be obtained as in the case of FIG. 19.

In the ninth to twelfth embodiments, while only the U-shaped magnetic core is shown as an example of the magnetic core 43, the E-shaped magnetic core can obtain the same results. With the E-shaped inductor core, in general, the coil is wound around the central portion thereof, and two magnetic gaps exist. The permanent magnets are arranged at two positions in the vicinity of both ends on the outside of the magnetic core, serving as means for generating magnetic bias. The E-shaped magnetic core will be described hereinbelow with reference to the drawings.

Figure 21:
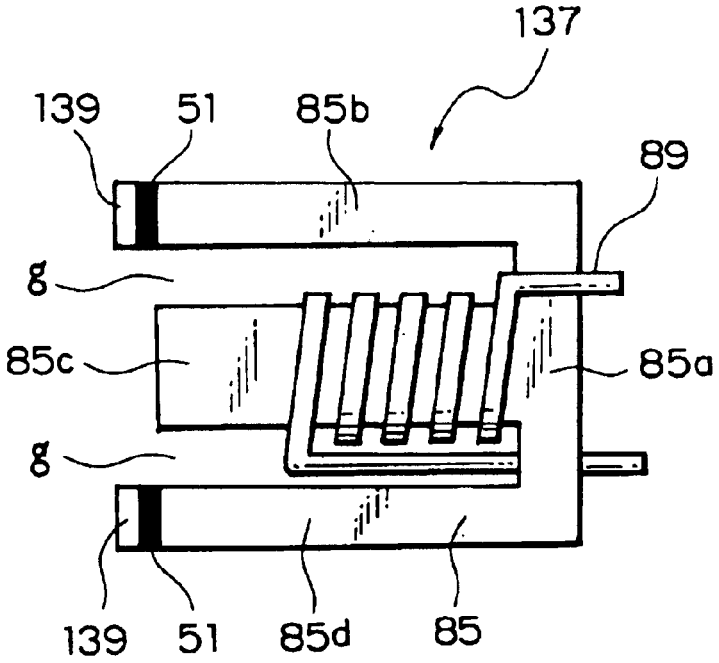
FIG. 21 is an explanatory view showing the configuration of an inductance component according to a thirteenth embodiment of the present invention when two permanent magnets are arranged such that the N-pole thereof is disposed in the same orientation as the extension of a magnetic path of an E-shaped inductor core.

Referring to FIG. 21, an inductance component 137 according to a thirteenth embodiment of the present invention includes the E-shaped magnetic core 85, the coil 89 wound around the central magnetic leg 85*c* of the magnetic core 85, permanent magnets 139 and 139 arranged at each end surface of the magnetic legs 85*b* and 85*d* provided on both sides of the central magnetic leg 85*c* of the magnetic core 85. Each permanent magnet 139 is mounted such that the side facing the magnetic core 85 is the N-pole 51.

In the thirteenth embodiment and the following embodiments, the magnetic core 85 is composed of one material, ferrite, and the permanent magnet 139 is also formed of one material, SmCo. The coil 89 wound around the magnetic core 85 is formed of the flat-type copper wire as in the case of U-shaped magnetic core.

Figure 22:
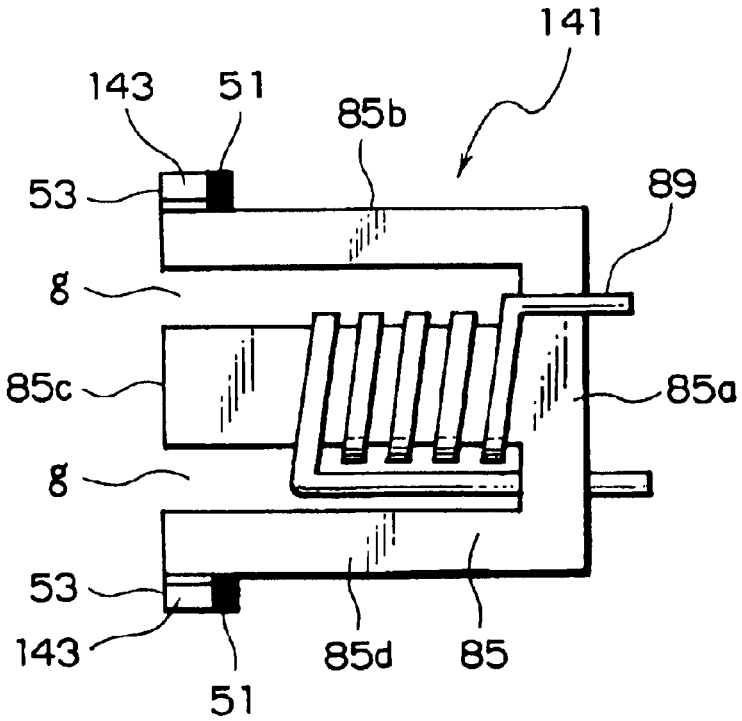
FIG. 22 is an explanatory view showing the configuration of an inductance component according to a fourteenth embodiment of the present invention when two permanent magnets are arranged such that the N-pole thereof is disposed in parallel with a magnetic path of an E-shaped inductor core.

Referring to FIG. 22, an inductance component 141 according to a fourteenth embodiment of the present invention is the same as that of the thirteenth embodiment in that it has the E-shaped magnetic core 85 and the coil 89 wound around the central magnetic leg 85*c* thereof. However, the fourteenth embodiment is different in that it has permanent magnets 143 and 143 arranged on the outside at each end of the magnetic legs 85*b* and 85*d* provided on both sides of the central magnetic leg 85*c* of the magnetic core 85. Each permanent magnet 143 is arranged such that the end surface side is the S-pole 53 and the base portion side is the N-pole 51.

Figure 23:
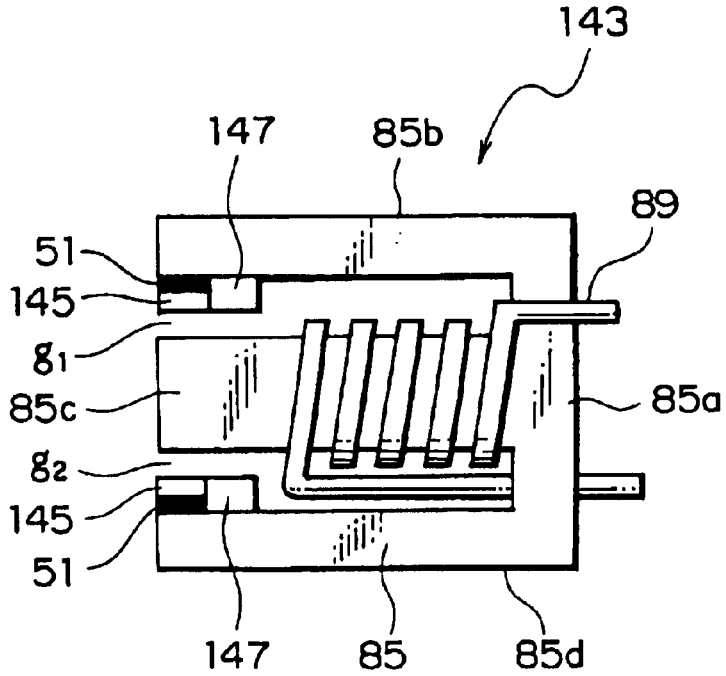
FIG. 23 is an explanatory view showing the configuration of the inductance component according to the fourteenth embodiment of the present invention when a permanent magnet and a small piece of core are disposed in each gap in an E-shaped inductor core.

Referring to FIG. 23, an inductance component 143 according to a fifteenth embodiment of the present invention is the same as those of the thirteenth embodiment and the fourteenth embodiment in that it has the E-shaped magnetic core 85 and the coil 89 wound around the central magnetic leg 85*c* thereof. However, the fifteenth embodiment is different in that it has planar permanent magnets 145 and 145 arranged on the inside (in the magnetic gap) of the magnetic legs 85*b* and 85*d* of the magnetic core 85 in such a manner that the inside is the N-pole, and has small pieces of core 147 and 147 arranged adjacent to the permanent magnets 145 at the base portion 85*a* side.

Figure 24:
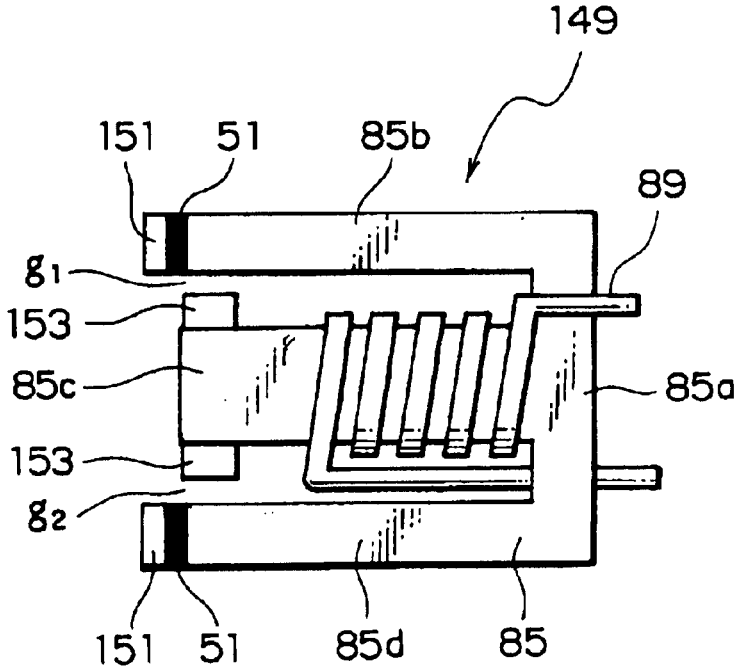
FIG. 24 is an explanatory view showing the configuration of an inductance component according to a fifteenth embodiment of the present invention when small pieces of core are disposed at the end of a central leg in a gap in an E-shaped inductor core and permanent magnets are disposed at ends of external legs on both sides of the core.

Referring to FIG. 24, an inductance component 149 according to a sixteenth embodiment of the present invention is the same as those of the thirteenth to fifteenth embodiments in that it has the E-shaped magnetic core 85 and the coil 89 wound around the central magnetic leg 85*c* thereof. However, the sixteenth embodiment has planar permanent magnets 151 and 151 arranged at each end surface of the magnetic legs 85*b* and 85*d* of the magnetic core 85 in such a manner that the inside is the N-pole, and also has small pieces of core 153 and 153 arranged at both sides of the end of the central magnetic leg 85*c*.

Figure 25:
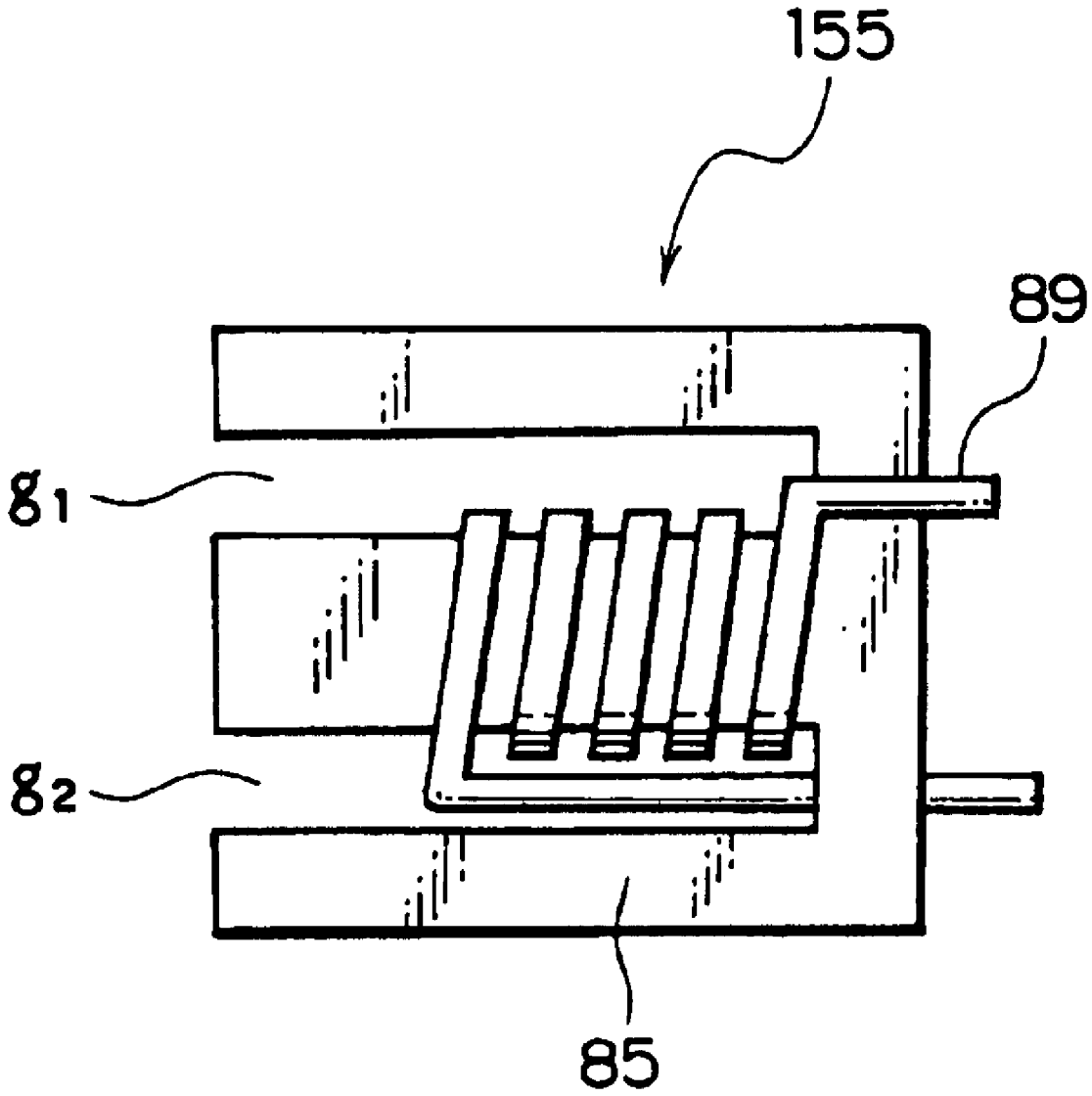
FIG. 25 is an explanatory view showing a comparative example in which no permanent magnet is disposed in the vicinity of an E-shaped inductor core.

Referring to FIG. 25, an inductance component 155 according to a comparative example includes the E-shaped magnetic core 85 and the coil 89 wound around the central magnetic leg 85*c* of the magnetic core 85. The planar permanent magnet and the small piece of core are not provided.

With the thirteenth embodiment shown in FIG. 21 and the comparative example shown in FIG. 25, superimposed direct current inductance is measured as in the case of the U-shaped magnetic core. It is found that the amplitude of the direct current at which superimposed direct current begins to decrease is increased by mounting the permanent magnet. Accordingly, with the magnetic core of the same composition and shape, the permanent magnet is mounted on the outside of the magnetic core, that is, at a position where magnetic flux due to the coil wound around the magnetic core is extremely little, so that a magnetic core capable of treating a larger direct current can be designed, as in the case of the U-shaped magnetic core.

As described above, in the ninth to sixteenth embodiments, a permanent magnet is mounted in the vicinity of the gap provided in the magnetic core, thereby generating magnetic bias. Furthermore, the piece of core is mounted in the gap, so that the permanent magnet can be mounted with high versatility. In this case, since the magnetic flux passing through the permanent magnet is extremely little due to the coil wound around the magnetic core, the permanent magnet is not demagnetized by the demagnetizing field due to the magnetic flux. Such effects can be obtained in any of the U-shaped magnetic core and the E-shaped core. By the above method, an inductor capable of treating a larger electric current and larger inductance than previous one can be obtained even if the size, shape, and material are the same. In other words, a smaller wire-wound components, such as an inductor and a transformer, can be manufactured without decreasing the amplitude of direct current being treated.

Next, a seventeenth embodiment of the present invention will be described.

Figure 26A:
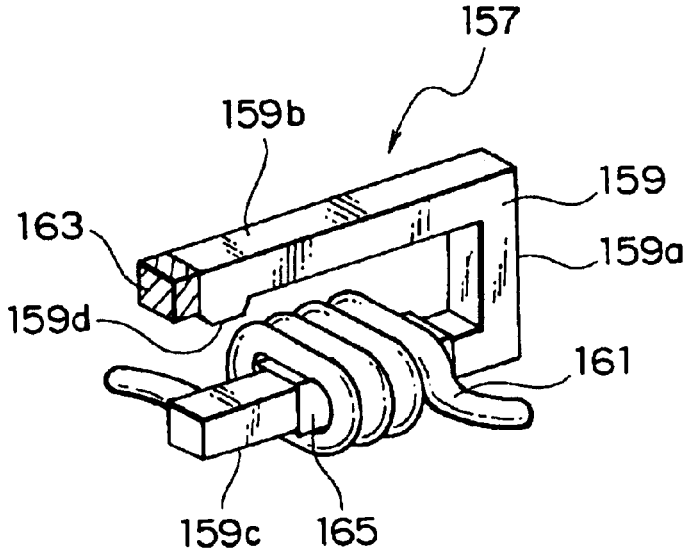
FIG. 26A is a perspective view showing an inductance component according to a seventeenth embodiment of the present invention.
Figure 26B:
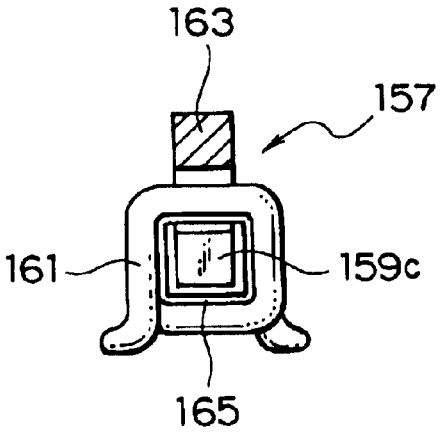
FIG. 26B is a front view of the inductance component shown in FIG. 26A.
Figure 26C:
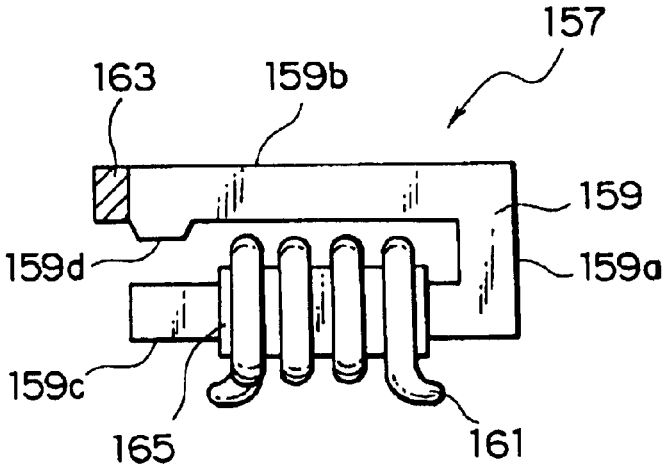
FIG. 26C is a side view of the inductance component shown in FIG. 26A.

Referring to FIGS. 26A, 26B, and 26C, an inductance component 157 according to the seventeenth embodiment of the present invention is used for a choke coil. The inductance component 157 includes a magnetic core 159 composed of a U-shaped soft magnetic material, and which has a base portion 159*a* and a pair of magnetic legs 159*b* and 159*c* extending from both ends of the base portion 159*a* to one end, and an exciting coil 161 wound around one of the magnetic legs 159*b* and 159*c* of the magnetic core 159. The exciting coil 161 is wound around the magnetic leg 159*c* via an insulating sheet 165, such as insulating paper, an insulating tape, a plastic sheet, etc. The magnetic core 159 is composed of silicon steel having permeability of $2\times10^{-2}$ H/m (thickly wound core of 50 $\mu$m) and has a magnetic path length of 0.2 m and an effective cross section of $10^{-4}$ $m^2$. Alternatively, metallic soft magnetic materials such as amorphous, permalloy, etc. or a soft magnetic materials such as MnZn-system and NiZn-system ferrite can be used.

A permanent magnet 163 is mounted on the end surface of one magnetic leg 159*b* of the magnetic core 159.

The permanent magnet 163 is formed of a bond magnet composed of rare-earth magnet powder having an intrinsic coercive force of 10 kOe (790 kA/m) or more, Curie temperature (Tc) of 500° C. or more, and an average particle size of 2.5 to 50 $\mu$m, which contains resin (30% or more in volume) and has specific resistivity of 1 Ωcm or more, in which, preferably, the composition of the rare-earth alloy is $Sm(Co_{bal}.Fe_{0.15\text{-}0.25}Cu_{0.05\text{-}0.06}Zr_{0.02\text{-}0.03})_{7.0\text{-}8.5}$, in which the kind of resin used for the bond magnet is any one of polyimide resin, epoxy resin, poly(phenylene sulfide) resin, silicone resin, polyester resin, aromatic nylon, and chemical polymer, in which the rare-earth magnet power is added a silane coupling material or a titanium coupling material, which becomes anisotropic by performing magnetic alignment when the bond magnet is manufactured in order to obtain high characteristics, and in which the magnetic field of the bond magnet is formed at 2.5 T or more and is then magnetized. Thus, a magnetic core having excellent direct current superpositional characteristics and causing no degradation in core loss characteristics can be obtained. In other words, magnetic characteristics necessary to obtain an excellent DC superpositional characteristic are an intrinsic coercive force rather than the product of energy. Accordingly, even if a permanent magnet of high specific resistivity is used, a sufficiently high DC superpositional characteristic can be obtained so long as the intrinsic coercive force is large.

Generally, while a magnet having high specific resistivity and a high intrinsic coercive force can be formed of a rare-earth bond magnet formed by mixing rare-earth magnetic powder with a binder, it is possible to use any magnetic powder having a high intrinsic coercive force. While there are various kinds of rare-earth magnetic powder, namely, SmCo system, NdFe system, and SmFeN system, a magnet having a Tc of 500° C. or more and a coercive force of 10 kOe (790 kA/m) or more is necessary in consideration of reflow condition and oxidation resistance, and as things stand, a $Sm_2Co_{17}$ system magnet is preferable.

A trapezoidal protrusion 159*d* protruding toward the magnetic leg 159*c* is integrally formed on the surface of the end of the magnetic leg 159*b* facing the magnetic leg 159*c*.

Figure 27:
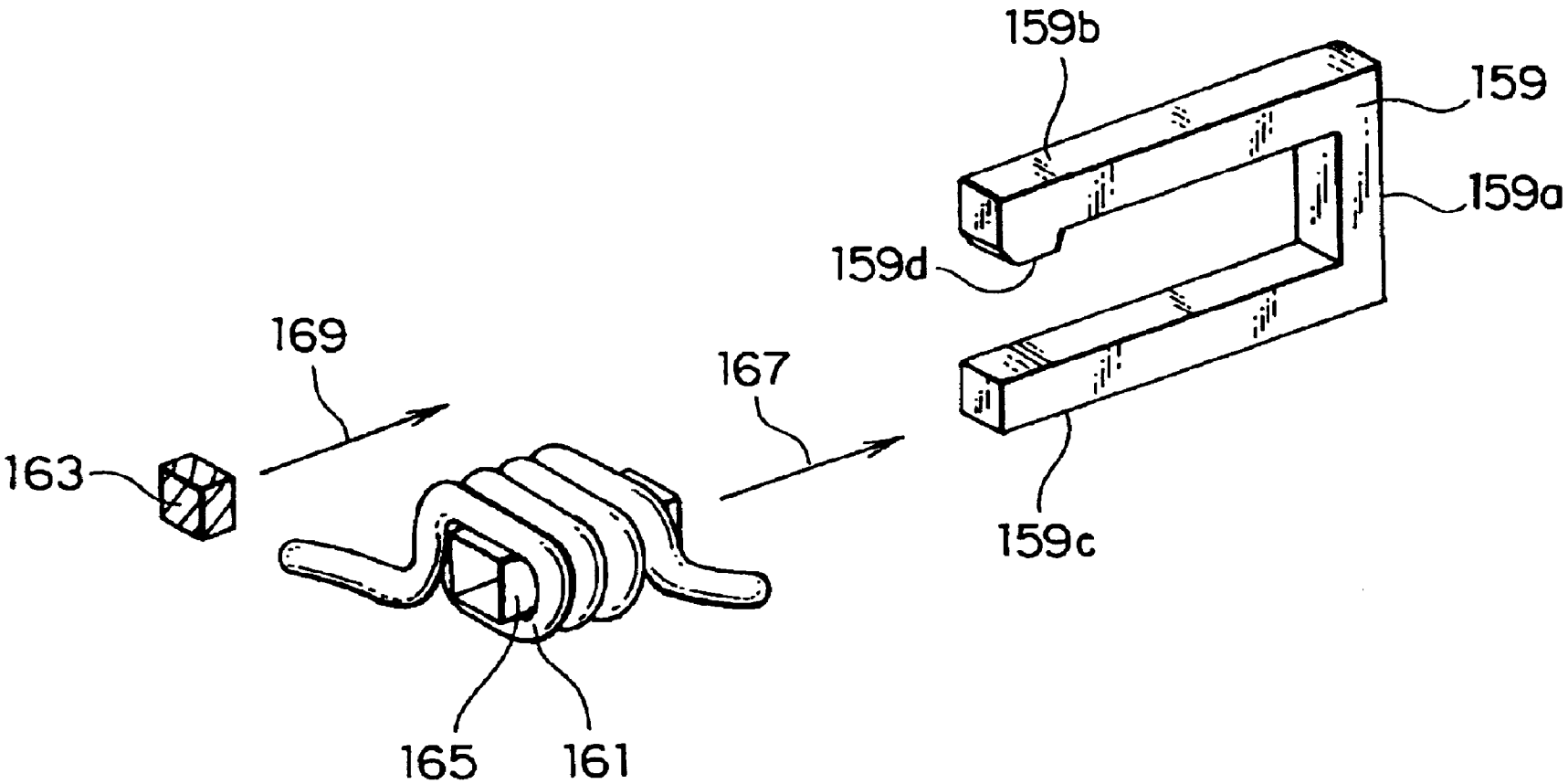
FIG. 27 is an exploded perspective view of the inductance component shown in FIG. 26A.

Referring to FIG. 27, an exciting coil 161 is mounted on one magnetic leg 159*c* of the magnetic core 159 via an insulating sheet 165. A permanent magnet 163 is placed on the end surface of the magnetic leg 159*b* facing the magnetic leg 159*c* having the exciting coil 161.

The temperature characteristics of the inductance components 105 and 157 at drive frequency of 100 kHz will be shown in the following Table 1.

TABLE 1

| Permanent magnet 107,163 | 9th embodiment | 17th embodiment |
|---|---|---|
| Temperature rise ΔT (° C.) | 10 | 5 |

As is apparent from Table 1, in the inductance component 157 according to the seventeenth embodiment of the present invention, rise in temperature of the permanent magnet is reduced.

Subsequently, the difference between the inductance component 157 according to the seventeenth embodiment and the inductance component 105 according to the ninth embodiment will be described.

Figure 29:
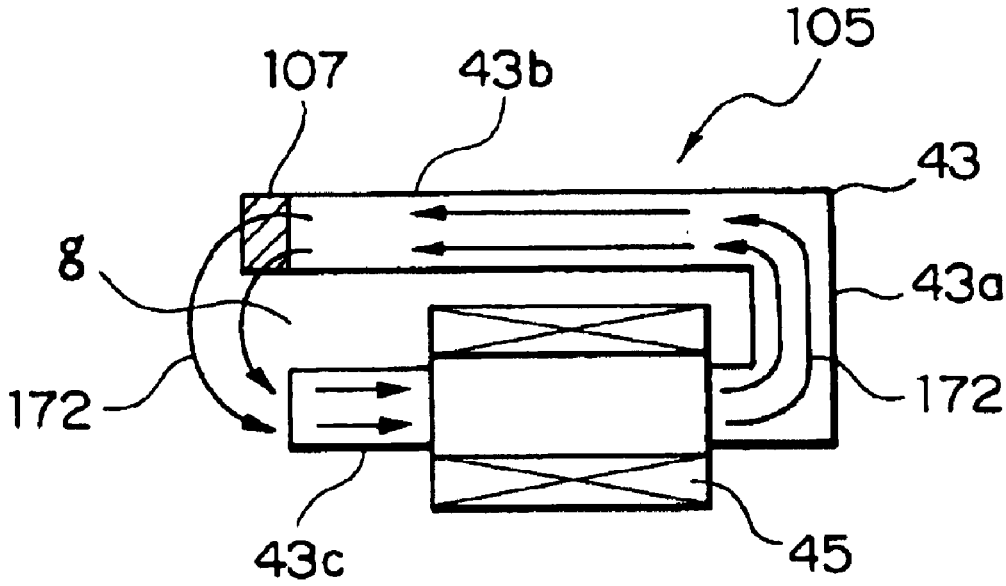
FIG. 29 is a side view for explaining the drawback of the inductance component shown in FIG. 15.

Referring to FIG. 29, in the inductance component 105 shown in FIG. 15, the permanent magnet 107 is arranged in the vicinity of the gap in order to prevent decrease in the magnetic inductance of the inductance component 105. The permanent magnet 107 is provided for magnetic biasing, and is placed so as to form a magnetic path in the direction opposite to the magnetic path formed by the exciting coil 45. The permanent magnet 107 for generating magnetic bias is used to apply DC magnetic bias to the magnetic core, and as a result, the number of lines of magnetic force capable of passing through the magnetic gap can be increased.

However, when a metallic magnetic material having high-saturation magnetic flux density (B), such as silicon steel, permalloy, or a material of amorphous system, is used for a magnetic core for a choke coil, even if a permanent magnet formed of a sintered compact, for example, a rare-earth magnet of Sm—Co system or Nd—Fe—B system, is arranged outside of magnetic flux, leakage flux flows into the permanent magnet since the ends of the magnetic core is formed in parallel with high-density magnetic flux of the magnetic core, as shown in FIG. 29. Consequently, the property of the choke coil is degraded, or heat is generated in the permanent magnet due to overcurrent loss, thereby degrading the property of the permanent magnet itself.

In a word, with the inductance component 105, since magnetic flux produced by the exciting coil passes through the permanent magnet, heat is generated due to the overcurrent loss, and thus the property may be degraded.

Figure 28:
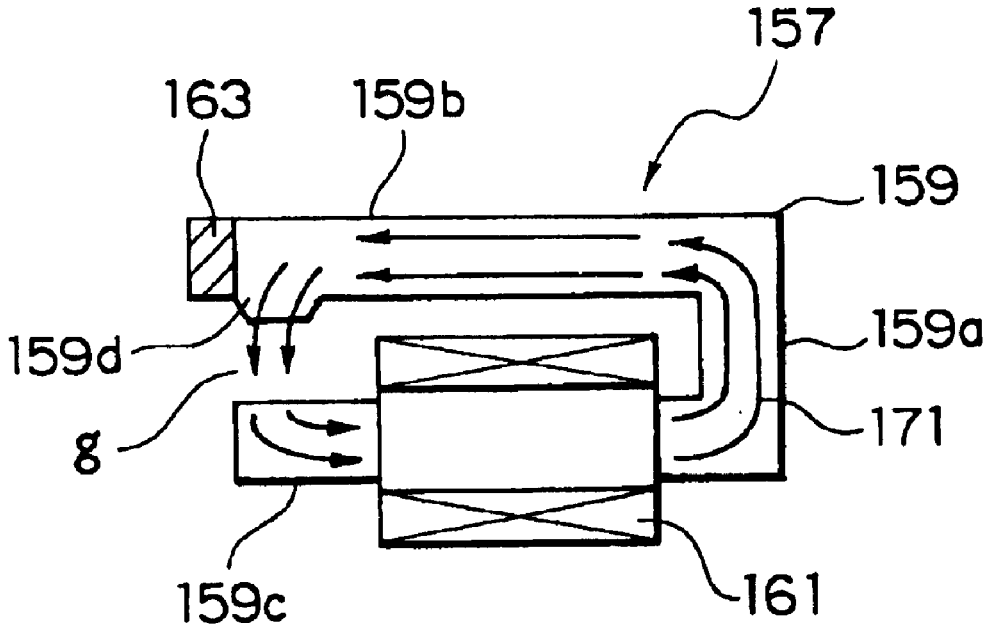
FIG. 28 is a side view for explaining the operation of the inductance component shown in FIG. 26A.

On the other hand, in the inductance component 157 shown in FIG. 28, magnetic flux 171 flowing from the exciting coil 161 through the base portion 159*a* does not leak to the permanent magnet 163 at the magnetic leg 159*b*, bends at the protrusion 159*d*, and then enters the other magnetic leg 159*c* facing the magnetic leg 159*b*. Accordingly, the permanent magnet 163 does not affected by the magnetic field produced by the exciting coil 161, and thus generating no heat due to the overcurrent loss in the magnetic field. Consequently, the inductance component 157 having higher reliability than that of components shown in FIGS. 15 and 29 can be provided, in which the permanent magnet 163 is not subjected to demagnetization or the like and has a stable and excellent property.

Accordingly, the inductance component 157 according to the seventeenth embodiment is significantly effective, particularly, when the permanent magnet 163 is formed of a sintered magnet or the like having a large overcurrent loss, and the drive frequency is increased in an electronic circuit using the inductance component.

As described above, according to the seventeenth embodiment of the present invention, a more reliable inductance component can be provided in which there is little limitation on the shape of the permanent magnet being mounted and generation of heat in the permanent magnet due to magnetic flux by the coil wound around the magnetic core is reduced, thereby causing no degradation of the property.

What is claimed is:

1. An inductance component comprising:

a U-shaped magnetic core having first and second magnetic legs and a magnetic gap defined between the first and second magnetic legs;

a permanent magnet mounted on an end portion of only the first magnetic leg in a vicinity of a general closed magnetic circuit which passes through the magnetic gap in the magnetic core but which does not pass through the permanent magnet, for generating a direct-current biased magnetic field; and a coil wound around the second magnetic leg.

2. An inductance component according to claim 1, wherein said permanent magnet is mounted on one of an end surface of the first magnetic leg and a side surface of the first magnetic leg.

3. A transformer comprising the inductance component according to claim 1.

* * * * *